US011235962B2

(12) United States Patent
Tijerina

(10) Patent No.: US 11,235,962 B2
(45) Date of Patent: Feb. 1, 2022

(54) FLOOR JACK WITH INTEGRATED SUPPORT AND METHOD OF USE

(71) Applicant: Raul Tijerina, Tonapah, AZ (US)

(72) Inventor: Raul Tijerina, Tonapah, AZ (US)

( * ) Notice: Subject to any disclaimer, the term of this patent is extended or adjusted under 35 U.S.C. 154(b) by 332 days.

(21) Appl. No.: 16/573,885

(22) Filed: Sep. 17, 2019

(65) Prior Publication Data

US 2020/0156910 A1 May 21, 2020

Related U.S. Application Data

(60) Provisional application No. 62/767,669, filed on Nov. 15, 2018.

(51) Int. Cl.
*B66F 5/04* (2006.01)
*B66F 3/30* (2006.01)
*B66F 3/36* (2006.01)

(52) U.S. Cl.
CPC ..... *B66F 5/04* (2013.01); *B66F 3/30* (2013.01); *B66F 3/36* (2013.01); *B66F 2700/02* (2013.01); *B66F 2700/052* (2013.01)

(58) Field of Classification Search
CPC ..... B66F 3/30; B66F 3/36; B66F 2700/02; B66F 17/00; B66F 1/00; B66F 1/02; B66F 1/04; B66F 1/08; B66F 5/00; B66F 5/04; B66F 5/02
See application file for complete search history.

(56) References Cited

U.S. PATENT DOCUMENTS 3,758,076 A * 9/1973 Tranchero ..... B66F 5/04 254/8 R
4,251,056 A * 2/1981 Maniglia ..... B66F 17/00 254/8 B
5,618,029 A * 4/1997 Chung ..... B66F 5/04 254/8 B
5,878,996 A * 3/1999 Loan ..... B66F 5/04 254/8 B
8,066,259 B2 * 11/2011 Fang ..... B66F 5/04 254/8 B
2008/0111117 A1 * 5/2008 Wu ..... B66F 5/04 254/8 R

* cited by examiner

*Primary Examiner* — Tyrone V Hall, Jr.
(74) *Attorney, Agent, or Firm* — Schmeiser, Olsen & Watts LLP

(57) ABSTRACT

A hydraulic floor jack with an integrated support is disclosed. The floor jack can be used with the floor jack oriented in any orientation relative to the orientation of a vehicle to be raised. The support remains suspended above the ground allowing the floor jack to roll along the ground while the vehicle is being raised. The support is then biased firmly on the ground, under weight of the vehicle, while the vehicle is suspended. A method of use of a hydraulic floor jack is also disclosed.

11 Claims, 9 Drawing Sheets

FLOOR JACK WITH INTEGRATED SUPPORT AND METHOD OF USE

CROSS REFERENCE TO RELATED APPLICATION

This application claims priority to U.S. Provisional Patent Application to Raul Tijerina entitled "FLOOR JACK WITH INTEGRATED SUPPORT AND METHOD OF USE," Ser. No. 62/767,669, filed Nov. 15, 2018, the disclosures of which are hereby incorporated entirely herein by reference.

BACKGROUND OF THE INVENTION

Technical Field

This invention relates generally to vehicle jacks and particularly to a hydraulic floor jack with an integrated support.

State of the Art

A hydraulic floor jack is commonly used to elevate a portion of a vehicle. To do so, a user typically places the floor jack under a portion of the frame of the vehicle. The floor jack is raised until a lift arm of the floor jack comes into contact with the frame of the vehicle. The user then uses leverage to raise a portion of the vehicle to a desired height with the floor jack.

Often, a portion of a vehicle is raised with a floor jack in order for the user to access the vehicle from underneath the vehicle to make repairs to the vehicle. However, it is not safe for a user to rely on a floor jack alone to keep the vehicle safely raised while the user is underneath the vehicle. The floor jack may fail, allowing the vehicle to fall and potentially seriously injure the user under the vehicle. Hydraulic systems, commonly used in floor jacks and other vehicle jacks are particularly prone to failure. It is therefore common for users to place one or more jack stands under a vehicle that has been raised by a floor jack in order to ensure that the vehicle remains safely in a raised position while the user performs repairs under the vehicle.

It is generally not possible for a conventional jack stand to occupy the same space as the floor jack. Typically, a jack stand must be placed under the frame of the vehicle at a second location. In some cases, it may be necessary to place more than one jack stand under the frame of the vehicle at more than one other location. To do so, the user typically uses the floor jack to temporarily raise a portion of the vehicle to more than the desired height. The user then places at least one jack stand, set at the desired height, under the vehicle at other locations. The user then lowers the floor jack until the vehicle comes to rest safely on the at least one jack stand at the desired height. To lower the vehicle again, the user uses the floor jack to temporarily raise the vehicle up and off of the at least one jack stand. The user then removes the at least one jack stand from under the vehicle. The user then lowers the floor jack until the vehicle comes to rest again safely on the ground.

Using jack stands in combination with using a floor jack can be cumbersome because a jack stand is an additional piece of equipment that must be used in addition to the floor jack. Furthermore, the jack stand supports the vehicle at a location that is different from the support location of the floor jack. This is particularly problematic for use with vehicles that have a unibody construction. Vehicles with unibody construction commonly have only one support location on each side of the vehicle, leaving no other suitable location for a jack stand, once that location has been taken up by the floor jack.

There are a number of conventional jack stand devices that work in conjunction with a floor jack such that the floor jack and the jack stand engage the vehicle at a single support location. For example, some conventional jack stands are configured such that a floor jack is used to raise the saddle of the jack stand, which in turn engages the support location on the vehicle. Some of these jack stands are separate pieces of equipment from the floor jack. Some require the user to reach down and under the vehicle to insert a locking pin into the jack stand to secure its position. Some have only one or very few locking positions. Some are not on wheeled supports and must be carried into position.

Some conventional hydraulic floor jacks have an integrated support. However, these can only be used in front or rear applications where the floor jack is generally parallel to the vehicle's wheels. This is because, with regard to ordinary floor jacks without the integrated support, the circular-type motion of the lift arm of the floor jack coming up and back, drawing the floor jack in and under the load requires the floor jack to move along the floor as the vehicle is being raised. Existing floor jacks with integrated supports are not able to roll along the ground while the vehicle is being raised up, because the jack stand is pressed solidly to the ground in response to the load of the vehicle while the vehicle is being raised up, requiring the remaining wheels of the vehicle to roll slightly along the ground as the rest of the vehicle is being raised.

Accordingly, what is needed is an improved floor jack having a wheeled frame with an integrated support that can be easily secured in any of a plurality of locked positions and that is not limited to use only in front or rear applications, where the floor jack is generally parallel to the vehicle's wheels, but can be used with the floor jack oriented in any orientation relative to the orientation of the vehicle.

SUMMARY OF THE INVENTION

The present invention relates to vehicle jacks and particularly to a hydraulic floor jack with an integrated support. The floor jack of the present invention can be used with the floor jack oriented in any orientation relative to the orientation of a vehicle to be raised.

Embodiments of a hydraulic floor jack of the present invention comprise a plurality of wheels coupled to a frame and engaging a support surface such that the frame is suspended above the support surface, whereby the hydraulic floor jack is able to roll along the support surface. A pair of spaced linear racks are disposed substantially parallel to each other and are hingedly coupled to the frame. The linear racks are interconnected via a support oriented substantially orthogonal to the linear racks. A biasing mechanism is coupled to the frame such that the biasing mechanism engages the support and linear rack assembly to maintain the support in a disengaged position in which the support remains suspended above the support surface, whereby the hydraulic floor jack remains free to roll along the support surface, both for positioning the floor jack under the vehicle and while a vehicle is being raised.

Each linear rack has a slide structure that is slideably mounted on the rack. Each of a pair of connecting arms is hingedly coupled to each slide structure, and also hingedly coupled to a lift arm of the hydraulic floor jack, such that the slide structures slide along the linear racks in response to the lift arm being raised or lowered.

A pair of pawls is interconnected via a pawl connector and each pawl is hingedly coupled to a slide structure. The pawls are configured to successively engage teeth of the racks as the slide structures slide along the racks in response to the lift arm being raised.

A pawl release mechanism is coupled to the pawl structure, whereby a user may disengage the pawls from the teeth, while in a disengaged position, thereby allowing the slide structures to slide freely along the racks in response to the lift arm being lowered. While the pawl release mechanism is in an engaged position, a downward force from the weight of a vehicle suspended by the lift arm is transmitted through the connecting arms and the slide structures to the pawls, such that the pawls engage teeth of the racks. In response, the racks rotate downward with respect to the frame, overcoming the biasing mechanism, to an engaged position, whereby the support is moved to contact the support surface in response to a user releasing the hydraulic fluid pressure of the hydraulic floor jack. The vehicle may thereby be raised and lowered with the hydraulic floor jack being oriented along any orientation with respect to the orientation of the vehicle.

Alternative embodiments comprise only one linear rack, with only one corresponding slide structure, connecting arm, and pawl. Principles of operation of a hydraulic floor jack comprising only one linear rack are the same as those for embodiments described above having two linear racks.

A method of use of a hydraulic floor jack with an integrated support is also disclosed.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
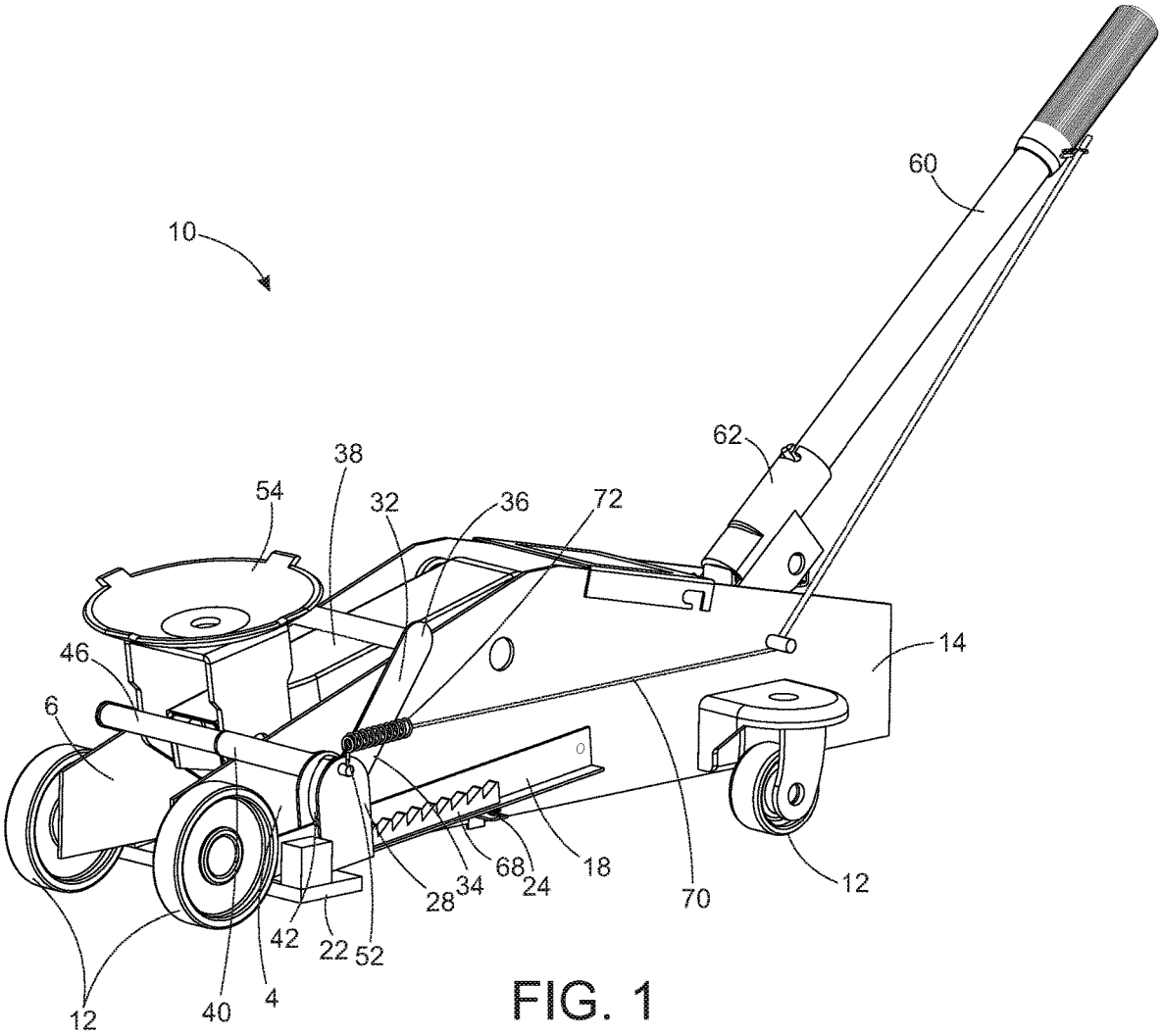
FIG. 1 is a perspective view of a floor jack with an integrated support according to an embodiment.

As discussed above, embodiments of the present invention relate to vehicle jacks and particularly to a hydraulic floor jack with an integrated support. The floor jack of the present invention can be used with the floor jack oriented in any orientation relative to the orientation of a vehicle to be raised.

Referring to the Figures, FIGS. 1-4, 7 and 8 show a hydraulic floor jack 10 with an integrated support according to an embodiment. The floor jack 10 may be used to raise a vehicle (not shown) and then securely support the vehicle after it has been raised. The floor jack 10 generally comprises a frame 14, a lift structure, and a support mechanism.

In some embodiments, the frame 14 may comprise substantially parallel spaced first and second side members 4 and 6 that are coupled together via at least one cross member 8. The at least one cross member 8 may be oriented substantially orthogonally to first and second side members 4 and 6. First and second side members 4 and 6 and the at least one cross member 8 may be formed from iron, such as angle iron, that is welded, bolted, or otherwise coupled together. The frame 14 may further comprises a plurality of wheels 12 operationally coupled to the frame 14, wherein the plurality of wheels 12 supports the frame 14 and engages a support surface 16, such as the ground, and supports the frame 14 such that the frame 14 does not contact the support surface 16.

Although the frame 14, as shown in the figures, comprises spaced first and second side members 4 and 6 that are coupled together via at least one cross member 8, this is not intended to be limiting. The frame 14 may comprise any of a single member or a plurality of a variety of members, or any combination thereof, configured in a manner that is consistent with the functions of a frame 14 of a floor jack 10.

Figure 2:
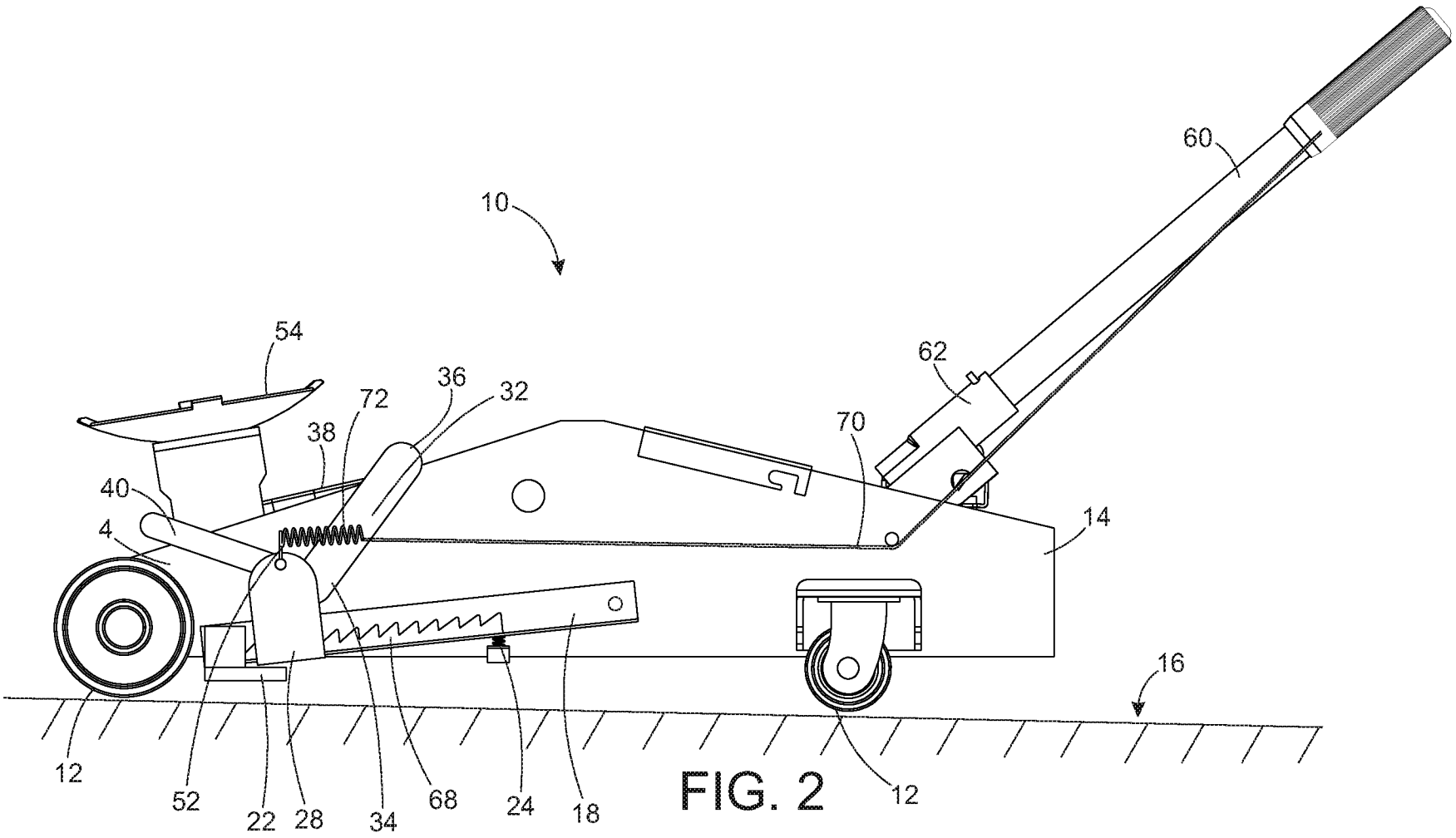
FIG. 2 is a side view of a floor jack in a lowered position according to an embodiment.
Figure 3:
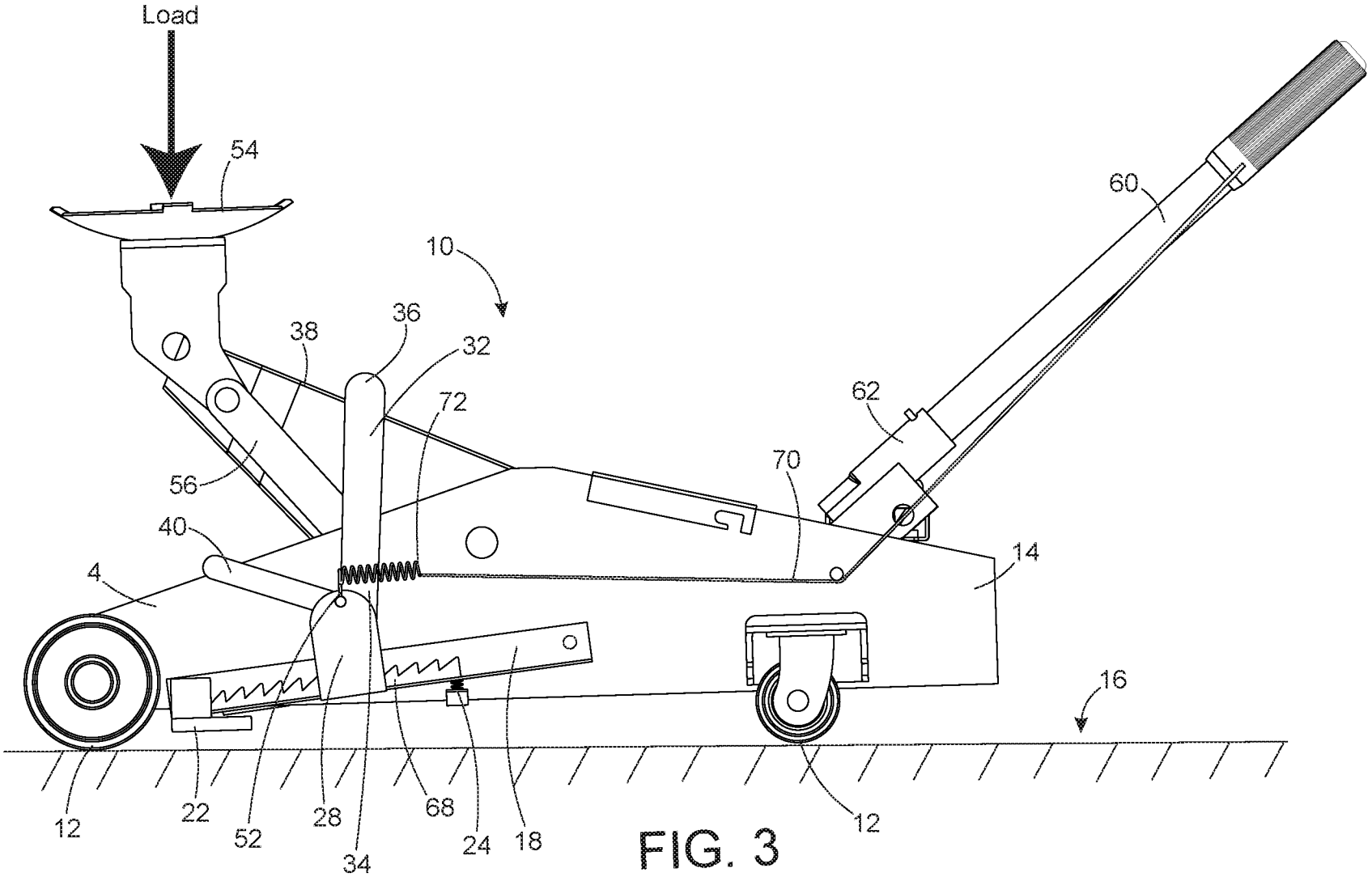
FIG. 3 is a side view of a floor jack in a raised position according to an embodiment.

In some embodiments, the lift structure may comprise a lift arm 38 with a lower end thereof hingedly coupled to the frame 14 and an upper end thereof hingedly coupled to a saddle 54 that is configured to engage a vehicle. A secondary arm 56 is similarly coupled to the frame 14 and to the saddle 54, such that the secondary arm 56 is substantially parallel to the lift arm 38. The lift arm 38, the secondary arm 56, the saddle 54, and the frame 14, together form a parallel four-bar linkage that maintains the upper surface of the saddle 54 substantially horizontal while in any position within its range of motion. The lift arm 38 may rotate with respect to the frame 14 to any position between a lowered position, as shown in FIG. 2, and a raised position, as shown in FIG. 3.

Figure 7:
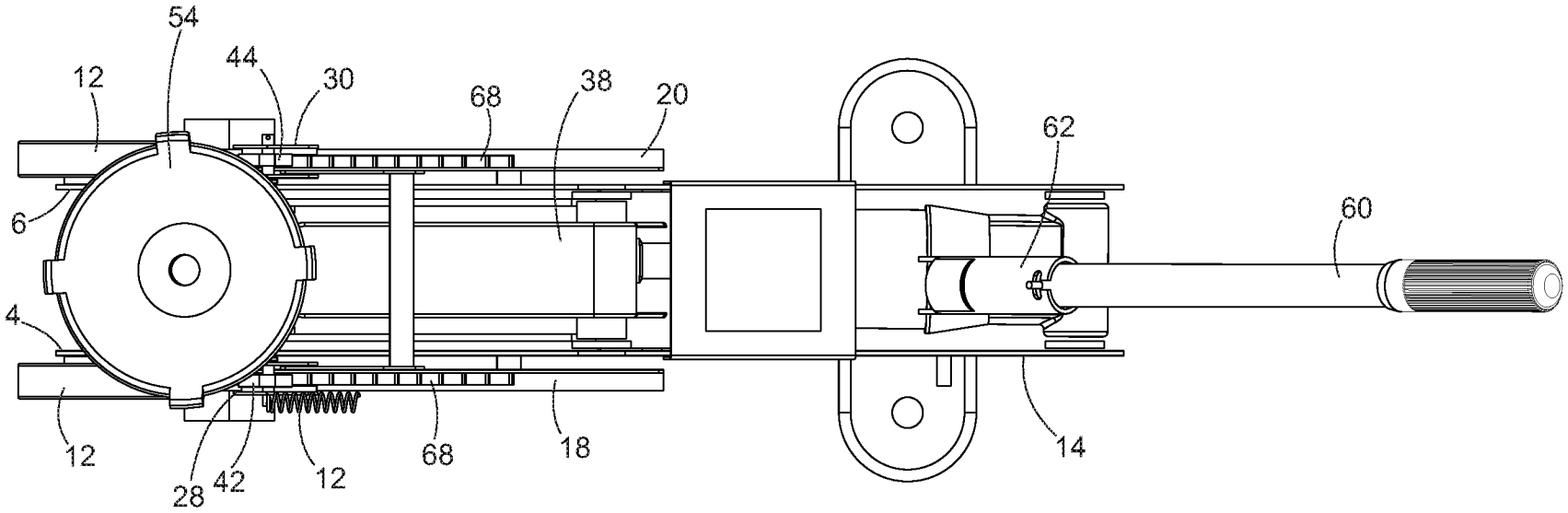
FIG. 7 is a top view of a floor jack with integrated support according to an embodiment.
Figure 8:
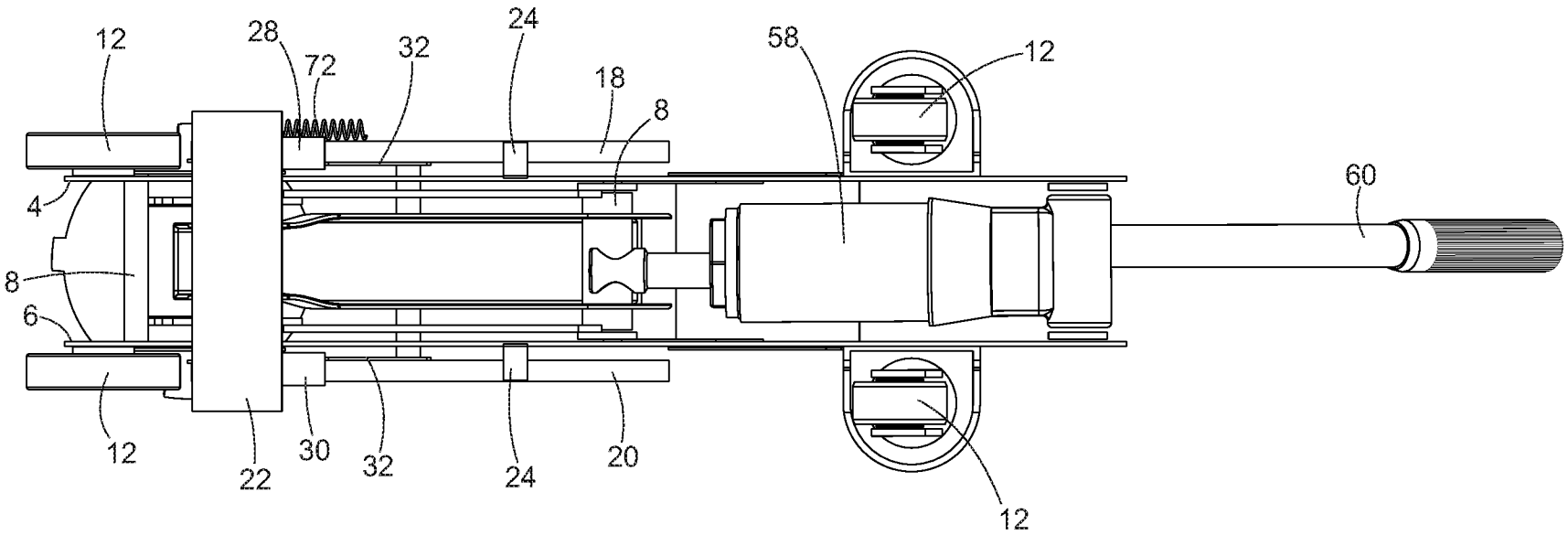
FIG. 8 is a bottom view of a floor jack with integrated support according to an embodiment.

The lift arm 38 may be raised by means of a hydraulic unit 58, or the like, such as is commonly used in hydraulic floor jacks. In embodiments, the hydraulic unit 58 may be operationally coupled to the frame 14 and to the lift arm 38 to raise the lift arm 38, as shown in FIGS. 7 and 8. An elongated handle 60 may be received into a socket 62 of a hydraulic pump of the hydraulic unit 58 and preferably extend rearward from the floor jack 10, as shown in FIGS. 1-4, 7 and 8. A user may thereby grasp the handle 60 and raise the lift arm 38, from a lowered position, as shown in FIG. 2, to a raised position, as shown in FIG. 3, while hydraulic pressure in the hydraulic unit 58 is locked, by pumping the handle 60 successively upward and downward to operate the hydraulic pump. The lift arm 38 may thereafter be returned to the lowered position, as shown in FIG. 2, by the weight of the vehicle and by gravity acting on the lift arm 38 when hydraulic pressure in the hydraulic unit 58 is released by the user.

Figure 4:
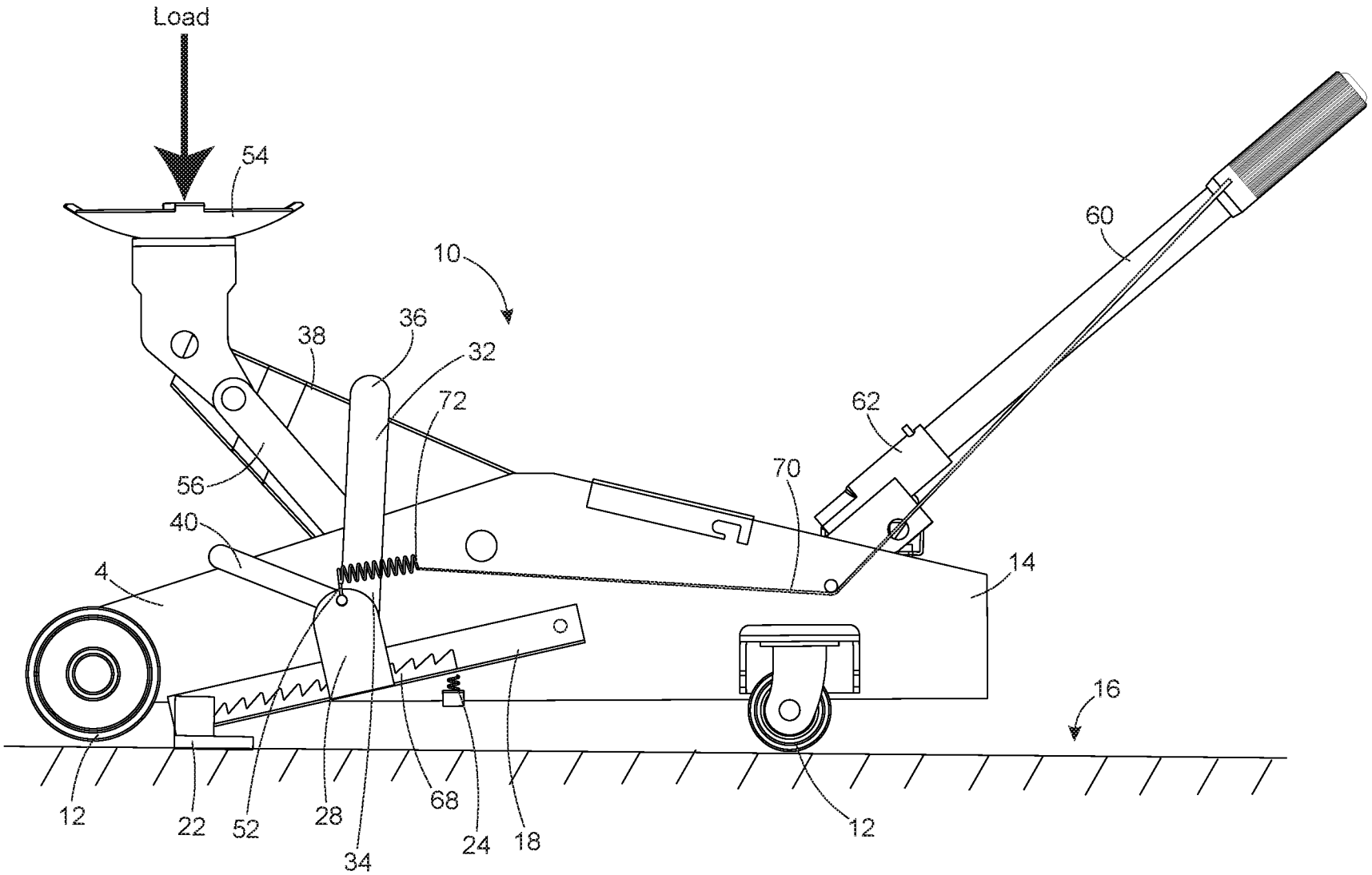
FIG. 4 is a side view of a floor jack in a loaded position according to an embodiment.
Figure 5:
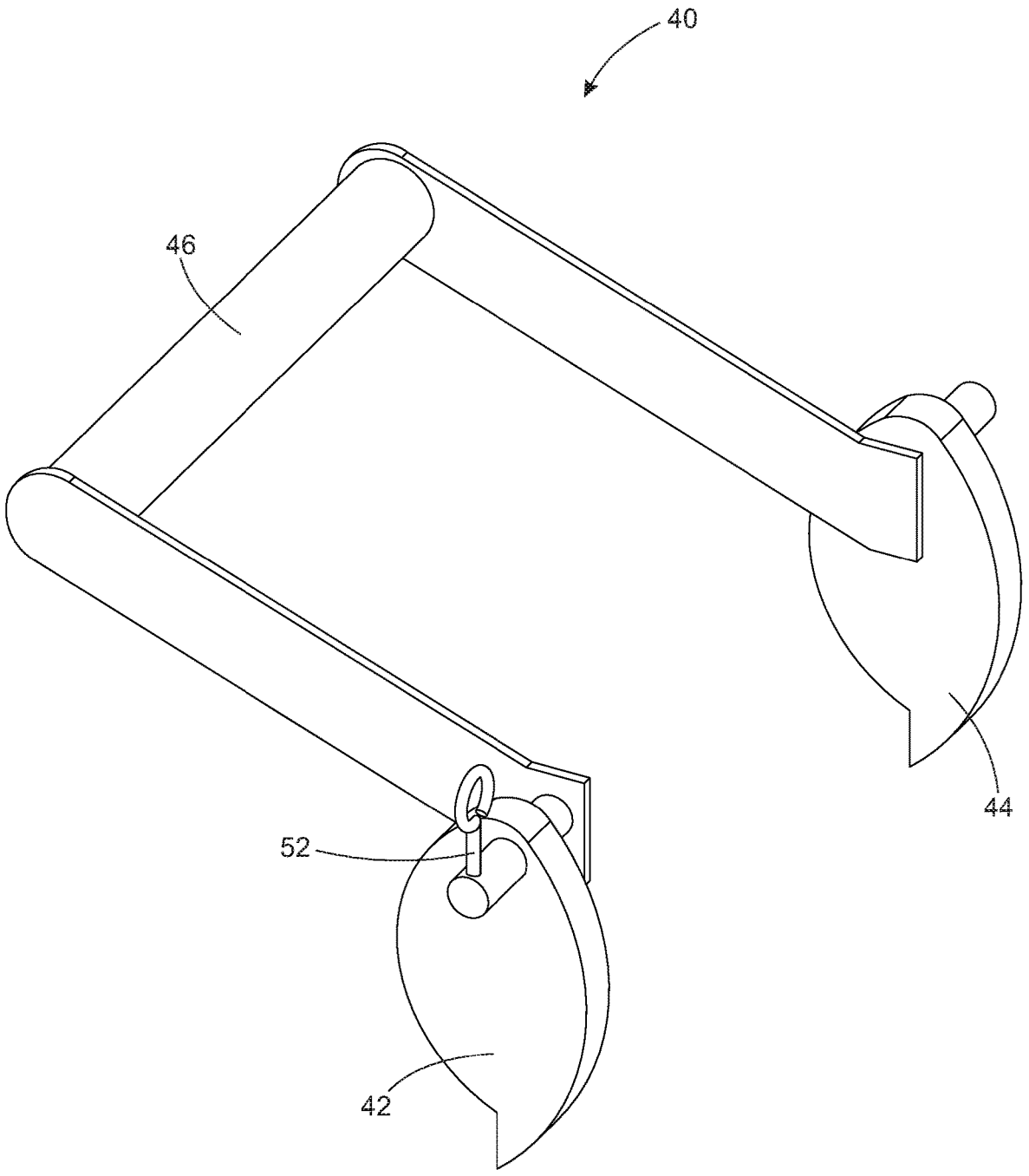
FIG. 5 is a perspective view of a pair of pawls coupled to a pawl connector according to an embodiment.
Figure 6:
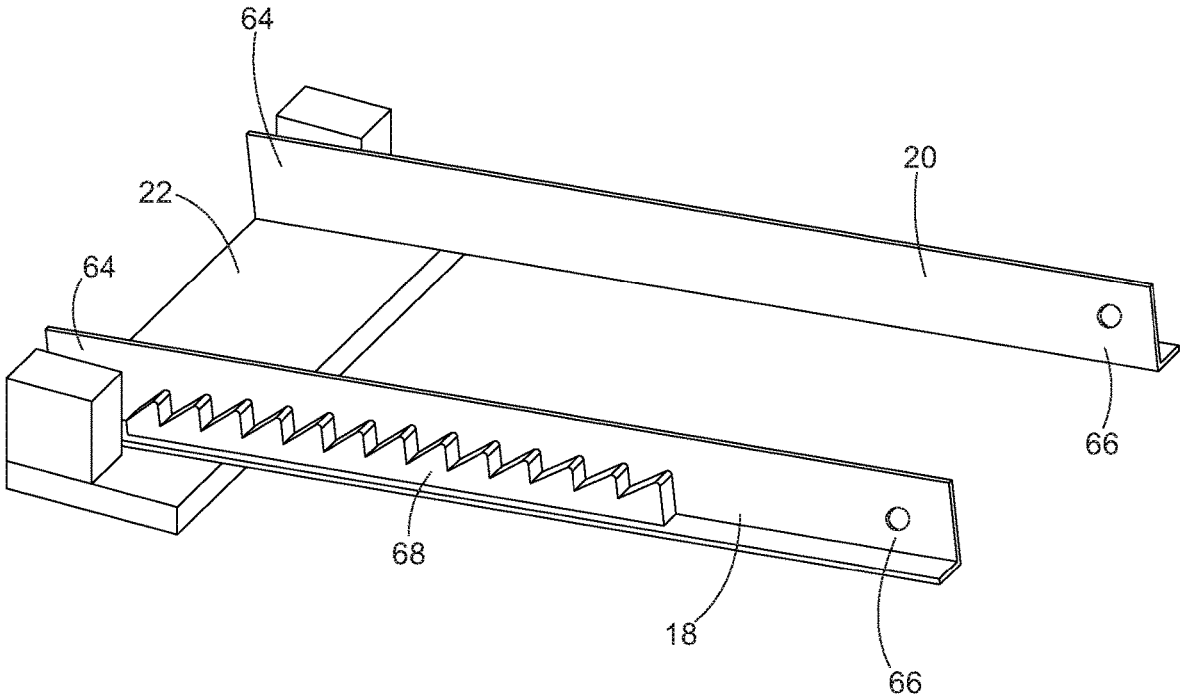
FIG. 6 is a perspective view of a pair of linear racks interconnected via a support according to an embodiment.

In some embodiments, the support mechanism may comprise a pair of spaced first and second linear racks 18 and 20, disposed substantially parallel to each other, each linear rack 18 and 20 having opposed first and second ends 64 and 66, the first ends 64 thereof being coupled to a support 22. The support 22 may be disposed substantially orthogonal to the linear racks 18 and 20 to act as a cross member to maintain the substantially parallel spacing of the linear racks 18 and 20, the support 22 being configured to engage the support surface 16 while the floor jack 10 is in a loaded position, as shown in FIG. 4. The support 22 may be a plate, a pad, a foot, or the like, and may be fixedly or hingedly coupled to the first ends 64 of each of the spaced linear racks 18 and 20.

In embodiments, each of the linear racks 18 and 20 has an array of teeth 68. Although each of the linear racks 18 and 20 shown has an array of teeth 68, this is not intended to be limiting. Each of the linear racks 18 and 20 may alternatively have an array of apertures, recesses, indentations, or other means of successive engagement with a pawl, or the like.

Each of the linear racks 18 and 20 may be hingedly coupled to the frame 14, such that the support 22 may rotate between an engaged position, as shown in FIG. 4, and a disengaged position, as shown in FIGS. 2 and 3. While in the engaged position, the support 22 may be biased against the support surface 16, as shown in FIG. 4. While in the disengaged position, the support 22 may be suspended above the support surface 16, as shown in FIGS. 2 and 3, by an any of a variety of upward biasing mechanisms 24. For example, in some embodiments, each of the linear racks 18 and 20 may rest on one of a pair of springs 24 coupled to the frame, such that the support 22 is biased against the lower surface of the frame 14 in response to the upward force of the springs 24 on the linear racks 18 and 20. However, this is not intended to be limiting. The support 22 may be suspended above the support surface 16 by any upward biasing mechanism 24 known to a person of skill in the art, such as by use of any of a variety of spring mechanisms, by the force of gravity on a weighted lever, or the like.

In embodiments, the support mechanism further may further comprise a first and second slide structure 28 and 30, each slide structure 28 and 30 overlying and being slideably mounted to one of the first and second linear racks 18 and 20, respectively. The support mechanism may further comprise a pair of connecting arms 32, each connecting arm 32 having opposed first and second ends 34 and 36. The first end 34 of each connecting arm 32 may be pivotally coupled to the lift arm 38 and each second end 36 may be pivotally coupled to one of the first and second slide structures 28 and 30, respectively, whereby the connecting arms 32 act to slide the slide structures 28 and 30 backward along the linear racks 18 and 20 as the lift arm 38 is being raised, and act to slide the slide structures 28 and 30 forward along the linear racks 18 and 20 as the lift arm 38 is being lowered.

In embodiments, each of the first and second slide structures 28 and 30 may contain one of a first and second pawl 42 and 44, respectively, hingedly coupled to the slide structures 28 and 30. The first and second pawls 42 and 44 may be coupled together by a pawl connector 46 to form a pawl structure 40. The pawl connector 46 may be essentially U-shaped, having a crossover bar and a pair of side arms extending downward therefrom, each of the pair of side arms being coupled one of the first and second pawls 42 and 44, respectively. Each of the first and second pawls 42 and 44 may be configured within the first and second slide structures 28 and 30, respectively, to engage the teeth 68 of the linear racks 18 and 20 in concert with each other, such that the slide structures 28 and 30, the connecting arms 32, the lift arm 38 and the saddle 54 are held securely in a fixed position relative to the frame 14 in response to a downward force of the vehicle, while in a loaded position, as shown in FIG. 4, due to the weight of the vehicle, on the saddle 54. The pawls 42 and 44 may engage the teeth 68 of the linear racks 18 and 20 when the pawl connector 46 rotates downward by the force of gravity on the pawl connector 46. When a user pumps the handle 60 to raise a vehicle with the floor jack 10, the connecting arms 32 may act to slide the slide structures 28 and 30 backward along the linear racks 18 and 20 as the lift arm 38 and saddle 54 are raised up. As the slide structures 28 and 30 slide backward, the pawls 42 and 44 may engage teeth 68 of the linear racks 18 and 20 in succession, in ratcheting fashion, until the vehicle is raised to a desired height.

In an embodiment of the present invention the support 22 remains suspended above the support surface 16 while the vehicle is being raised from a lowered position, as shown in FIG. 2 to a raised position, as shown in FIG. 3. This allows the floor jack 10 to roll forward while the vehicle is being raised and backward while the vehicle is being lowered. If not for this feature, the floor jack 10 would be restricted to use in front or rear applications where the floor jack 10 is generally parallel to the vehicle's wheels. This is because the circular-type motion of the saddle 54 and lift arm 38 coming up and back, drawing the floor jack 10 in and under the load of the vehicle requires the floor jack 10 to move relative to the vehicle. The reverse is true while the vehicle is being lowered. Existing floor jacks with integrated supports are not able to move while the vehicle is being raised up, because the support is pressed solidly to the ground in response to the load of the vehicle while the vehicle is being raised up, requiring the vehicle to move slightly relative to the floor jack. The present invention thus allows the floor jack 10 to be used in any orientation, relative to the orientation of the vehicle, including, but not limited to, orthogonally to the vehicle, such as from a side of the vehicle, for example.

Once the user raises the vehicle to the desired height, the user may release the fluid pressure of the hydraulic unit 58. The downward force of the vehicle on the saddle 54, due to the weight of the vehicle, may then be transmitted through the lift arm 38 and the connecting arms 32, through the pawls 42 and 44 to the linear racks 18 and 20, thereby overcoming the springs 24, or other upwardly biasing mechanisms 24, to move the support 22 downward to engage the support surface 16, such that the floor jack 10 is unable to roll, and the vehicle may thereby be safely secured in its loaded position, as shown in FIG. 4, without the inherent risk of failure of the lift structure of the floor jack 10.

To lower the vehicle, the user may then lock the hydraulic fluid pressure of the hydraulic unit 58 and pump the handle 60 to raise the saddle 54, thereby releasing the support 22 from the support surface 16 and allowing the floor jack 10 to roll again. The pawls 42 and 44 may be disengaged from the teeth 68 of the linear racks 18 and 20 by any of a variety of pawl retention mechanisms known by a person of skill in the art. For example, a lever 52 may be coupled to one of the first or second pawls 42 or 44. A cable 70, or the like, may be strung from an outer end of the lever 52, through an eyelet mounted to the frame 14 proximate the socket 62, to a latch mechanism coupled to the handle 60 at a location on the handle 60 that is convenient to the user. The user may pull the cable 70, which in turn pulls the lever 52 to disengage the pawls 42 and 44 from the teeth 68 of the linear racks 18 and 20. The latch mechanism may be used to secure the pawls 42 and 44 in a disengaged position. The user may then lower the vehicle by releasing the fluid pressure of the hydraulic unit 58, thereby allowing the weight of the vehicle and gravity to lower the saddle 54 and the lift arm 38. The slide structures 28 and 30 are thereby able to slide freely along the linear racks 18 and 20 because the pawls 42 and 44 are disengaged from the teeth 68 of the linear racks 18 and 20. Releasing the cable latch mechanism may allow the pawls 42 and 44 to engage the teeth 68 of the linear racks 18 and 20 again for raising the vehicle.

In some embodiments, the cable 70 may comprise a spring 72 that is stretched when the user pulls the cable 70 while the floor jack 10 is in a loaded position, as shown in FIG. 4. This is because the pawls 42 and 44 remain engaged with the teeth 68 in response to the weight of the vehicle. When the user begins to raise the lift arm 38 slightly, in preparation for lowering the vehicle, the force of the spring 72 on the lever 52 may then release the pawls 42 and 44, such that the vehicle may be lowered again, the slide structures 28 and 30 being free to slide forward to the lowered position, as shown in FIG. 2.

Although embodiments of a hydraulic floor jack 10, as described above, comprise two linear racks 18 and 20, this is not intended to be limiting. In some embodiments, a hydraulic floor jack 10 comprises only one linear rack, with only one corresponding slide structure, connecting arm, and pawl. In embodiments with only one linear rack, the linear rack may be disposed longitudinally between the pair of side members 4 and 6 of the frame 14, or it may be disposed along the outside of the frame 14 along either of the pair of side members 4 and 6. Embodiments may comprise only one linear rack, or two linear racks, or more than two linear racks, with a suitable number of slide structures, connecting arms, and pawls, corresponding to the number of liner racks, accordingly. Principles of operation of a hydraulic floor jack 10 comprising only one linear rack, or more than two linear racks, are the same as those for embodiments disclosed above having two linear racks 18 and 20.

Figure 9:
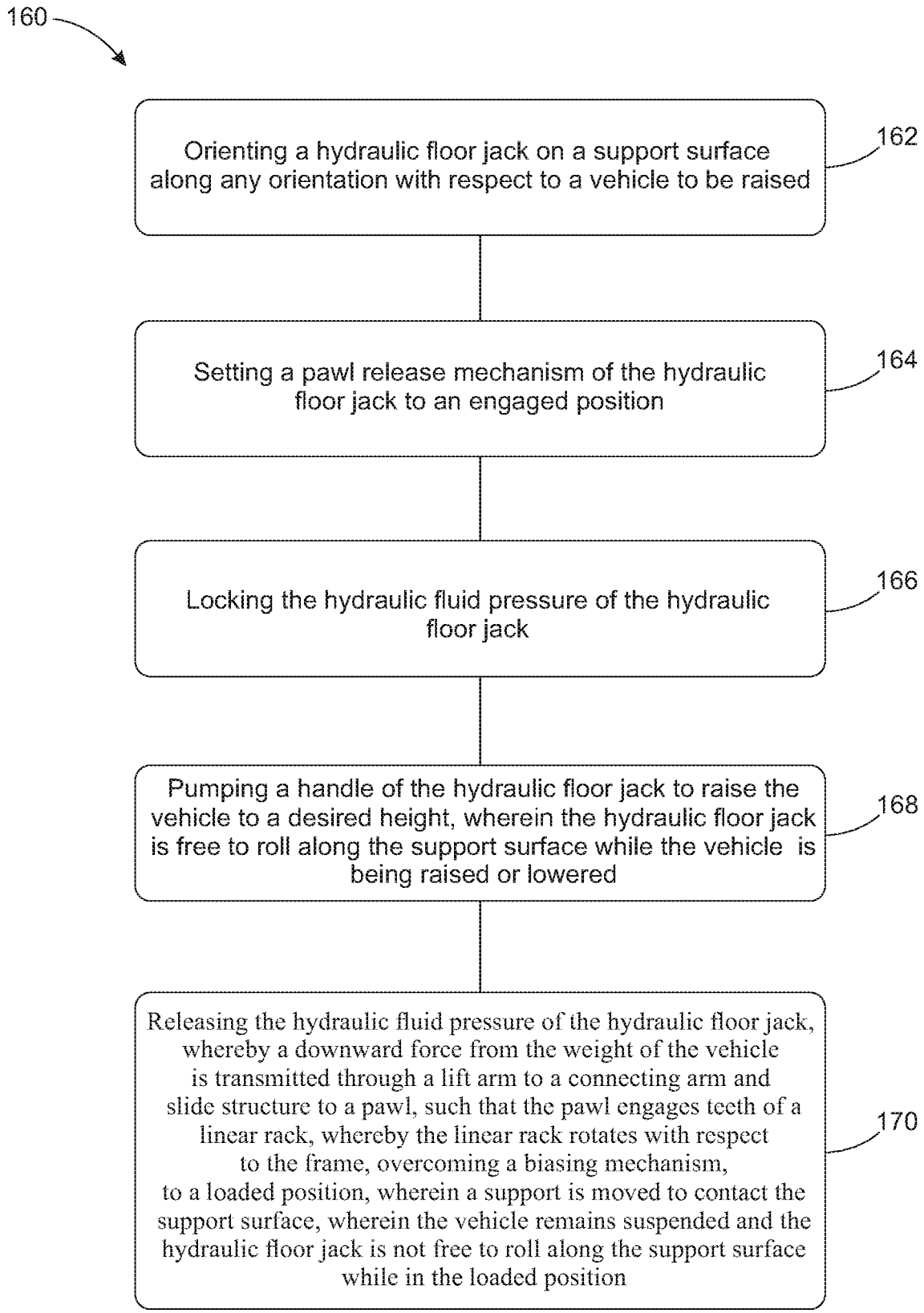
FIG. 9 is a view of a flow chart depicting a method of using a floor jack with integrated support according to an embodiment.

FIG. 9 depicts a method of use 160 of a hydraulic floor jack with integrated support. The method of use 160 comprises the steps: orienting a hydraulic floor jack on a support surface along any orientation with respect to a vehicle to be raised (Step 162); setting a pawl release mechanism of the hydraulic floor jack to an engaged position (Step 164); locking the hydraulic fluid pressure of the hydraulic floor jack (Step 166); pumping a handle of the hydraulic floor jack to raise the vehicle to a desired height, wherein the hydraulic floor jack is free to roll along the support surface while the vehicle is being raised or lowered (Step 168); and releasing the hydraulic fluid pressure of the hydraulic floor jack, whereby a downward force from the weight of the vehicle is transmitted through a lift arm to a connecting arm and slide structure to a pawl, such that the pawl engages teeth of a linear rack, whereby the linear rack rotates with respect to the frame, overcoming a biasing mechanism, to a loaded position, wherein a support is moved to contact the support surface, wherein the vehicle remains suspended and the hydraulic floor jack is not free to roll along the support surface while in the loaded position. (Step 170).

The method of use of a hydraulic floor jack may further comprise: locking the hydraulic fluid pressure again; using the handle to raise the vehicle; setting the pawl release mechanism to a disengaged position, wherein the biasing mechanism returns the support to an unloaded position; and releasing the hydraulic fluid pressure, whereby a downward force from the weight of the vehicle lowers the lift arm, wherein the slide structure is allowed to freely slide along the linear rack.

It is an advantage of the method of use, as depicted in FIG. 9, that the hydraulic floor jack may be oriented along any direction with respect to the vehicle, such as from the side of the vehicle, for example. This is an advantage over use of some conventional hydraulic floor jacks having an integrated support, which can only be used in front or rear applications where the floor jack is generally parallel to the vehicle's wheels. As explained above, this is because, with regard to ordinary floor jacks without the integrated support, the circular-type motion of the lift arm of the floor jack coming up and back, drawing the floor jack in and under the load requires the floor jack to move along the floor as the vehicle is being raised. Existing floor jacks with integrated supports are not able to roll along the ground while the vehicle is being raised up, because the support is pressed solidly to the ground in response to the load of the vehicle while the vehicle is being raised up, requiring the remaining wheels of the vehicle to roll slightly along the ground as the rest of the vehicle is being raised. In contrast, the floor jack of the present invention is free to roll along the ground, even in a direction that is not parallel to the orientation of the vehicle, because the support is not in contact with the ground during raising and lowering of the vehicle. The floor jack of the present invention is therefore may be used to raise and lower a vehicle without moving the vehicle along the direction of travel of the floor jack.

The components defining any floor jack with an integrated jack stand may be formed of any of many different types of materials or combinations thereof that can readily be formed into shaped objects provided that the components selected are consistent with the intended operation of a floor jack with an integrated jack stand. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any floor jack with an integrated jack stand may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, sewing, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A hydraulic floor jack, comprising:

a frame;

a plurality of wheels operatively coupled to the frame and configured to rest on a support surface and suspend the frame above the support surface;

a hydraulic lift mechanism operatively coupled to the frame;

a first linear rack hingedly coupled to the frame, the first linear rack comprising a first array of teeth along a first surface thereof;

a second linear rack hingedly coupled to the frame, the second linear rack comprising a second array of teeth along a second surface thereof;

a support coupled between the first and second linear racks, wherein the support may be rotated between a loaded position in contact with the support surface and an unloaded position above the support surface, wherein, while in the unloaded position, the hydraulic floor jack is free to roll along the support surface and, while in the loaded position, the hydraulic floor jack is prevented from rolling along the support surface due to friction between the support and the support surface;

a biasing mechanism coupled between the frame and the support to bias the support toward the unloaded position;

a pawl structure, further comprising:

a first pawl operationally coupled to the first linear rack;

a second pawl operationally coupled to the second linear rack; and a pawl connector coupled between the first and second pawls, wherein:

the pawl structure is moveable between an engaged position and a disengaged position;

the first and second pawls successively engage the first and second arrays of teeth, respectively, in the engaged position in response to the hydraulic lift mechanism lifting a load; and the pawl structure in the engaged position transmits the load lifted by the hydraulic lift mechanism to the first and second linear racks to rotate the first and second linear racks and move the support toward the support surface in response to disengaging the hydraulic lift mechanism.

2. The hydraulic floor jack of claim 1, wherein the first and second pawls are biased to engage teeth of the first and second arrays of teeth, respectively, by the force of gravity acting on the pawl structure.

3. The hydraulic floor jack of claim 1, wherein the first and second pawls are biased to engage teeth of the first and second arrays of teeth, respectively, by a second biasing mechanism operationally coupled between the pawl structure and the frame.

4. The hydraulic floor jack of claim 1, wherein, when the load is a wheeled vehicle having wheels thereof aligned in a first direction and the plurality of wheels of the hydraulic floor jack are aligned in a second direction, the hydraulic floor jack may be used to raise the load while the support is in the unloaded position, support the load while the support is in the loaded position, and lower the load while the support is in the unloaded position, without moving the load in the second direction.

5. A hydraulic floor jack, comprising:

a frame;

a plurality of wheels operatively coupled to the frame and configured to rest on a support surface and suspend the frame above the support surface;

a hydraulic lift mechanism operatively coupled to the frame;

a linear rack hingedly coupled to the frame, the linear rack comprising an array of teeth along a surface thereof;

a support coupled to the linear rack, wherein the support may be rotated between a loaded position in contact with the support surface and an unloaded position above the support surface, wherein, while in the unloaded position, the hydraulic floor jack is free to roll along the support surface and, while in the loaded position, the hydraulic floor jack is prevented from rolling along the support surface due to friction between the support and the support surface;

a biasing mechanism coupled between the frame and the support to bias the support toward the unloaded position;

a pawl operatively coupled to the linear rack, wherein:

the pawl is moveable between an engaged position and a disengaged position;

the pawl successively engages the array of teeth in the engaged position in response to the hydraulic lift mechanism lifting a load; and the pawl in the engaged position transmits the load lifted by the hydraulic lift mechanism to the linear rack to rotate the linear rack and move the support toward the support surface in response to the disengaging the hydraulic lift mechanism.

6. The hydraulic floor jack of claim 5, wherein the pawl is biased to engage teeth of the array of teeth by the force of gravity acting on the pawl.

7. The hydraulic floor jack of claim 5, wherein the pawl is biased to engage teeth of the array of teeth by a second biasing mechanism operationally coupled to the pawl.

8. The hydraulic floor jack of claim 5, wherein, when the load is a wheeled vehicle having wheels thereof aligned in a first direction and the plurality of wheels of the hydraulic floor jack are aligned in a second direction, the hydraulic floor jack may be used to raise the load while the support is in the unloaded position, support the load while the support is in the loaded position, and lower the load while the support is in the unloaded position, without moving the load in the second direction.

9. A method of use of a hydraulic floor jack, comprising:

orienting a hydraulic floor jack on a support surface along any orientation with respect to a vehicle to be raised;

setting a pawl release mechanism of the hydraulic floor jack to an engaged position;

locking the hydraulic fluid pressure of the hydraulic floor jack;

pumping a handle of the hydraulic floor jack to raise the vehicle to a desired height, wherein the hydraulic floor jack is free to roll along the support surface while the vehicle is being raised or lowered; and releasing the hydraulic fluid pressure of the hydraulic floor jack, whereby a downward force from the weight of the vehicle is transmitted through a lift arm to a connecting arm and slide structure to a pawl, such that the pawl engages teeth of a linear rack, whereby the linear rack rotates with respect to the frame, overcoming a biasing mechanism, to a loaded position, wherein a support is moved to contact the support surface, wherein the vehicle remains suspended and the hydraulic floor jack is not free to roll along the support surface while in the loaded position.

10. The method of use of a hydraulic floor jack of claim 9, further comprising:

locking the hydraulic fluid pressure again;

using the handle to raise the vehicle;

setting the pawl release mechanism to a disengaged position, wherein the biasing mechanism returns the support to an unloaded position; and releasing the hydraulic fluid pressure, whereby a downward force from the weight of the vehicle lowers the lift arm, wherein the slide structure is allowed to freely slide along the linear rack.

11. The method of use of a hydraulic floor jack of claim 9, wherein, when the vehicle is aligned in a first direction and the hydraulic floor jack is aligned in a second direction, the vehicle is not moved in the second direction as the vehicle is being raised.

* * * * *